US005899844A

United States Patent [19]

Eberle, Sr.

[11] Patent Number: 5,899,844

[45] Date of Patent: May 4, 1999

[54] METHOD OF CONTROLLING THE DENSITY OF THE SOLIDS SEPARATED FROM A FEED SLURRY IN A SEPARATOR

[76] Inventor: Louis C. Eberle, Sr., 758 Mueller Rd., Warminster, Pa. 18974

[21] Appl. No.: 08/880,898

[22] Filed: Jun. 23, 1997

[51] Int. Cl.[6] ..... B04B 11/00; B04B 13/00

[52] U.S. Cl. ..... 494/37; 494/1; 494/10; 494/27; 494/35; 494/53

[58] Field of Search ..... 494/1, 5, 10, 23, 494/27, 30, 32, 35, 37, 42, 50–54; 210/194, 196, 765, 805

[56] References Cited

U.S. PATENT DOCUMENTS

| | | | |
|---|---|---|---|
| 2,473,297 | 6/1949 | Parker . | |
| 2,528,974 | 11/1950 | Ritsch . | |
| 3,070,291 | 12/1962 | Bergey . | |
| 3,200,068 | 8/1965 | Jonakin et al. . | |
| 3,623,657 | 11/1971 | Trump . | |
| 4,228,950 | 10/1980 | Ito . | |
| 4,297,225 | 10/1981 | Hartley . | |
| 4,298,159 | 11/1981 | Epper et al. . | |
| 4,327,862 | 5/1982 | Jakobs . | |
| 4,339,072 | 7/1982 | Hiller . | |
| 4,643,709 | 2/1987 | Lee et al. | 494/37 |
| 4,661,243 | 4/1987 | Hotz et al. . | |
| 4,761,157 | 8/1988 | Shapiro | 494/35 |
| 4,762,622 | 8/1988 | Thijssen . | |
| 4,978,331 | 12/1990 | Luchetta | 494/37 |
| 5,267,936 | 12/1993 | Miachon | 494/22 |
| 5,282,780 | 2/1994 | Epper et al. | 494/1 |
| 5,300,014 | 4/1994 | Chin et al. | 494/35 |
| 5,527,474 | 6/1996 | Leung . | |
| 5,601,523 | 2/1997 | Knelson | 494/37 |

FOREIGN PATENT DOCUMENTS 385629 6/1973 U.S.S.R. .

OTHER PUBLICATIONS

Westfalia Separator Data Sheet CA755, High–Efficiency Clarifier Decanter.

Westfalia Separator Data Sheet CA505, High–Performance Clarifying Decanter.

*Primary Examiner*—Charles E. Cooley

*Attorney, Agent, or Firm*—Stuart E. Beck

[57] ABSTRACT

A method and apparatus for controlling the density of the solids separated from a feed slurry by selectively recirculating the separated liquid component of the feed slurry to change the feed slurry's density when an unwanted density of the separated solids is detected. Further, the efficiency of the separation is increased by recirculating and recharging unused catalyst into the feed slurry where it is used to assist in the separation of the solids.

9 Claims, 1 Drawing Sheet

METHOD OF CONTROLLING THE DENSITY OF THE SOLIDS SEPARATED FROM A FEED SLURRY IN A SEPARATOR

FIELD OF THE INVENTION

This invention relates to a water treatment system, and more particularly, to a water treatment system using a centrifuge with a scroll conveyor.

BACKGROUND OF THE INVENTION

In water treatment systems dissolved and suspended solids are separated from the liquid so that the liquid can be processed for re-introduction into the water supply or discharged harmlessly into reservoir or estuary such as a river or stream.

Typically a centrifuge comprising a bowl whose interior rotatably supports a scroll conveyor is used at an early stage in water treatment to assist in the separation of the solids.

As is well known, the mixture of raw water and solids, often called a "feed slurry," enters the centrifuge at one end of the bowl. The solids are separated by the interaction of gravity, the speeds of rotation of the centrifuge bowl and the scroll as well as their relative speeds of rotation.

Additionally a catalyst is often used to assist in the separation of the solids. Typically the catalyst is a suitable electrically charged polymer. The polymer charge may be positive or negative in accordance with the nature of the separation to be achieved as will be more fully explained. Suitable polymer is available from Cytec, Industries, Inc. (formerly known as American Cyanamid Corporation) in West Paterson, N.J. under the brand name SUPERFLOC C-457 which is a cationic polyacrylamide family.

The solids are collected and can be used for a variety of purposes such as fertilizers, landfills, fuels for incinerators and the like.

It is recognized that the solids are best handled when their consistency is at a predetermined level. Preferably, the solids should be dry since this makes them easier to handle. If they are too wet, they become heavy as a result of the water they contain and are costly to handle and ship.

Thus, it is well known in the industry to try to control the density of the solids exiting the centrifuge by regulating relative speeds of the scroll and the centrifuge bowl.

However, this technique is limited by the density of the feed slurry entering the centrifuge.

Further refinements in controlling the density of the solids exiting the centrifuge include the recirculation of the solids to increase their concentration in the centrifuge so that the density of the solids finally exiting the centrifuge can be controlled.

While this means for controlling the density of the solids exiting the separator has been satisfactory for the most part, it suffers from the following deficiencies.

Since the density of the exiting solids is substantially proportional to the density of the feed slurry, a very dense feed slurry will create solids that tend to reduce the flow of material through the centrifuge or even block it entirely. Therefore, a very dense slurry will cause the rate at which the centrifuge unloads to increase and remain high until a feed slurry having a lighter density is detected. This causes an uneven product since the exiting solids will have alternately dry and wet portions in accordance with the density of the feed slurry. The increased wetness of the solids increases the cost of disposal since the wet solids cost more to transport than dry solids due to their weight and further, the increased moisture makes them more difficult to incinerate.

SUMMARY OF THE INVENTION

With the foregoing in mind, the invention relates generally to a method of controlling the density of the solids separated in a separator from a feed slurry which comprises the steps of detecting the density of the feed slurry, identifying a desired density for the separated solids, separating the liquid component of the feed slurry from the solid component while in the separator, and permitting them to exit separately.

If density of the feed slurry falls above the predetermined range then some or all of the separated liquid is returned to the separator to reduce the density of the solids.

In another aspect the invention related to the method of controlling the density of the solids separated in a separator from a feed slurry where a catalyst is added to the feed slurry to assist in the separation of the solid component from the liquid component of the feed slurry and selectively recirculating unused catalyst that exits from said separator.

In still another aspect, the invention relates to an apparatus for controlling the density of the solids separated from a feed slurry, which comprises a centrifuge having a solids outlet and a liquids outlet. The solids exit from the solids component outlet while the liquids exit from the liquid outlet. A detector is provided for detecting the density of the solids. If the density of the solids rises above a predetermined level, the exiting liquid is returned to the separator to dilute the solids.

In yet another aspect, the invention relates to an apparatus for controlling the density of the solids separated from a feed slurry which includes means for adding a catalyst to the feed slurry to assist in the separation of the solid component from the liquid component of the feed slurry and means for selectively recirculating unused catalyst that exits from said separator.

DETAILED DESCRIPTION OF THE INVENTION

Figure 1:
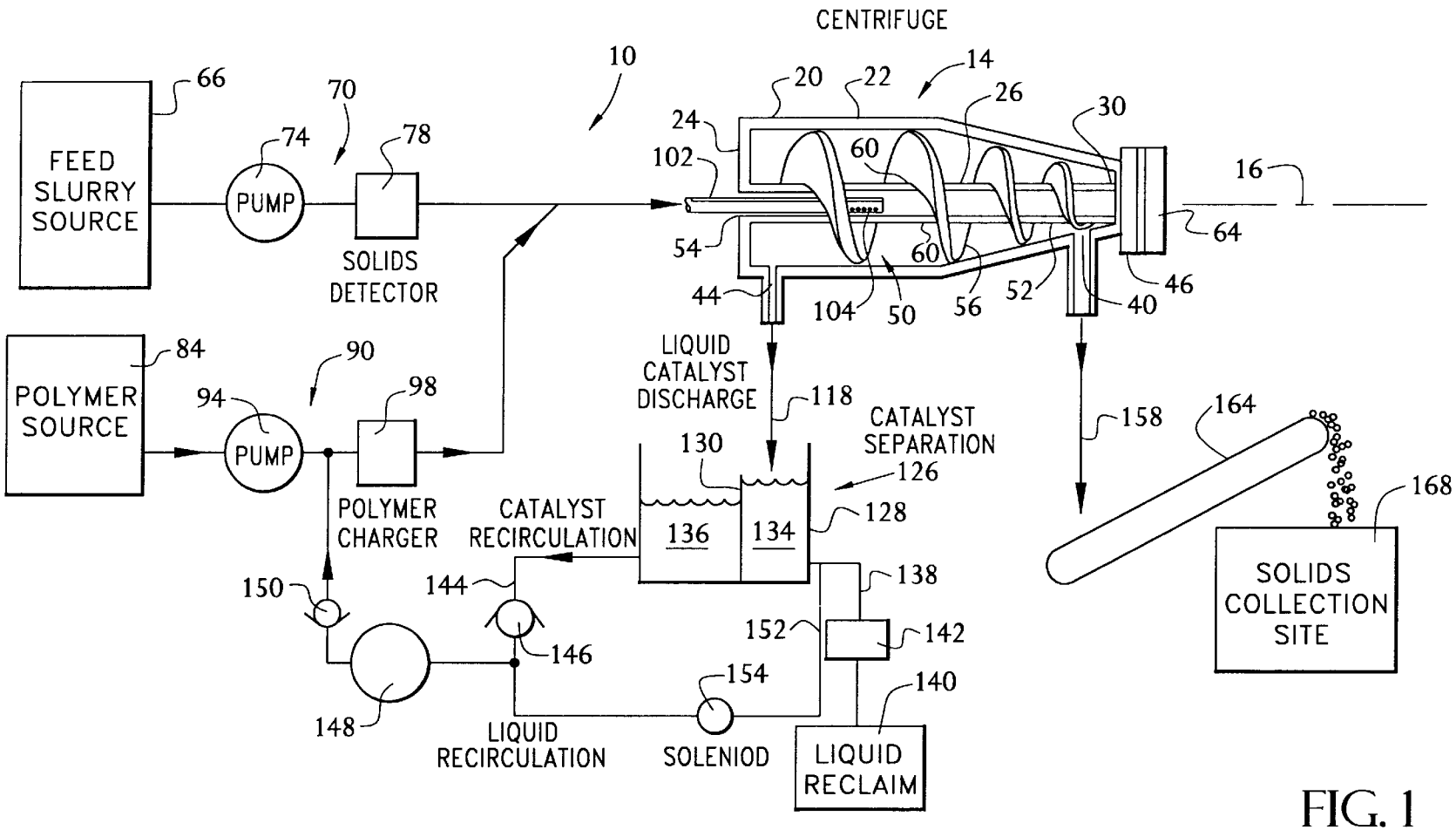
FIG. 1 is a schematic drawing of the method and apparatus comprising the invention.

The invention can be best understood by referring to the accompanying drawing where a separation system 10 constructed in accordance with a presently preferred form of the invention is illustrated.

The separation system 10 includes a P-I-D controller (not shown) and a centrifuge 14. The P-I-D (proportional-integral-derivative) controllers are well known devices for use in process control since they can be programmed to detect signals emanating from process equipment and compare them to a model of the process and then generate signals to control the process. They are connected to the motors, valves and pumps in the separation system 10 as will be more apparent from the following description.

The centrifuge 14 is supported for rotation about a horizontal axis 16. The centrifuge includes an outer bowl 20. The outer bowl 20 includes a cylindrical body portion having 22 an end wall 24 and a tapered body portion 26 having an end wall 30.

The tapered body portion 26 includes an outlet 40 near end wall 30 through which separated solids exit the centrifuge 14.

The cylindrical body portion 22 includes an outlet 44 near end wall 24 through which separated liquid exits the centrifuge 14.

The bowl 20 is driven by a main or variable speed drive motor indicated schematically at 46 for rotation about horizontal axis 16.

Contained within the centrifuge 14 and extending through the end 24 is a scroll 50. The scroll 50 comprises an elongated hollow cylindrical member 52 rotatably mounted on end walls 24 and 30 within the bowl 20 about the horizontal axis 16. The elongated hollow cylindrical member 52 defines an opening 54 in end wall 24. Member 52 supports an auger blade 56 on its outer wall. The auger blade 56 is sufficiently wide so that it can reach the inner surface of the cylindrical body 22 so as to almost scrape them. The scroll 50 is driven by a variable speed drive motor indicated schematically at 64 for rotation about horizontal axis 16.

The hollow cylindrical member 52 includes a plurality of distribution ports 60 that connect its hollow interior with the interior of the bowl 20.

As is well known, waste water in the form of a feed slurry containing both solid and liquid components is supplied to the centrifuge 14 from a suitable source 66, such as a sewage system, preliminary treatment plant, potable water plant, or the like.

The feed slurry is delivered to the centrifuge 14 through a plurality of conduits 70 by a variable speed pump 74. A suitable solids detector and charger 78 in a conduit 70 detects the density of the feed slurry before it enters the centrifuge 14. Preferably, the solids detector 78 operates by shaking a predetermined volume of the feed slurry and determining the frequency of the responsive vibration. Since the frequency of vibration is proportional to the density of the slurry a particular detected frequency of vibration corresponds to a particular density.

In addition the detector may be used to apply a positive or negative charge to the feed slurry to increase the the effectiveness of the catalyst.

To assist and hasten the rate of speed at which the separation of the solids and the liquid take place, a suitable catalyst is provided. Typically, the catalyst is cationic, i.e., positively charged for waste water treatment plants; anionic, i.e., negatively charged for potable water plants. In some instances, the catalyst may be non-ionic, i.e., neutral. The above mentioned polyacrylamide is a well known as being useful for this purpose. The catalyst is introduced into the feed slurry from a suitable source 84 by conduit 90.

The polymer conduit 90 includes a variable speed polymer feed pump 94 and a polymer charger 98. The polymer charger 98 is used to restore the charge to polymer since it is dissipated during through contact with the feed slurry and also as it ages. Thus, the polymer charger 98 is operative to raise or lower the charge level of the polymer, therefore increasing its operational efficiency.

The charged polymer is added to the feed slurry as it enters the centrifuge 14 by way of feed conduit 102. The distal end 104 of the feed conduit 102 extends into the elongated cylindrical member 52 to deliver the feed slurry to the distribution ports 60.

By selectively combining polymer and feed slurry and varying the relative speeds of the bowl 20 and scroll 50, substantial control over the clarity of the liquid leaving centrifuge through liquid outlet 44 can be achieved.

However, the density of the solids will for the most part be proportional to the concentration of solids in the feed slurry. Further not all of the catalyst is used in the separation process.

The present invention overcomes this deficiency by providing for the recirculation of the of the correct amount of separated liquid and unused catalyst when the density of the feed slurry is too high for optimum continuous operation.

To achieve these goals, the liquid outlet 44 is connected by conduit 118 to a catalyst separation unit 126. The catalyst separation unit 126 may comprises a tank 128 having a partition 130 that divides it into a first sub-tank 134 and a second sub-tank 136.

The liquid component of the feed slurry includes the unused catalyst since the used catalyst has combined with the solids. It is discharged through conduit 118 into first sub-tank 134, from which it is skimmed into second sub-tank 136 for subsequent use.

The catalyst-free water exits from first sub-tank 134 through conduit 138 into a suitable liquid reclamation facility 140. An optical detector 142 in conduit 138 is used to determine the clarity of the water leaving first sub-tank 134.

The separated catalyst exits from second sub-tank 136 through conduit 144 and check valve 146. Catalyst recycle variable speed feed pump 148 pumps the catalyst through check valve 150 back into conduit 90 and polymer charger 98 at a speed determined by the controller. Thus, the unused catalyst can be recirculated through the system.

A by-pass conduit 152 that includes a motorized valve 154 controlled by the PID controller is connected between conduit 138 and the inlet to the catalyst recycle variable speed feed pump 148. Thus, the density of the recirculated catalyst can be controlled.

The separated solids exit the centrifuge 14 through solids outlet 40 and conduit 158. The solids may then be transferred by a suitable conveyor system 164 which may include vehicles to a collection and processing site or the like 168.

The separating system is used to create solids of a predetermined density. The density of the solids discharged from the system can be detected by the amount of torque necessary to rotate the scroll 50. Since the torque increases with the density of the solids, detection of a torque above a predetermined level will cause the controller to energize the catalyst recycle feed pump to dilute that slurry to a consistency which can be handled by the centrifuge.

Further, as an alternative to detecting the scroll torque the density detector and charger 78 may be used. Thus, when the density detector and charger 78 detects that the feed slurry density is above a predetermined level, the controller energizes the catalyst recycle feed pump.

Thus, one of the important advantages of the invention is that the density of the exiting solids can be controlled to a level that has not been available with conventional centrifuge systems that rely only on the rotational speeds of the bowl and scroll. Thus, the operator has the ability to adjust the density of the solids component in accordance with the subsequent use that is intended for it.

Further, the costs of operating the system are dramatically reduced since the unused catalyst which previously was discarded is recovered and used.

Thus, while the invention has been described by referring to its presently preferred forms, it is apparent that other forms and embodiments will be obvious to those skilled in the art from the foregoing description. Thus, the scope of the invention should not be limited by the description, but rather, only by the scope of the appended claims.

What is claimed is:

1. In the method of controlling the density of the solids separated in a separator from a feed slurry which feed slurry includes both a liquid component and suspended solids component, the improvement comprising the steps of identifying a desired density range for said separated solids;

permitting said feed slurry to enter said separator;

adding a catalyst to said feed slurry;

separating the liquid component of said feed slurry from the solids component by using said catalyst;

permitting the separated liquid and solids components of said feed slurry to exit from said separator separately;

selectively returning some of said separated liquid component to said separator to change the density of the entering feed slurry when the density of said separated solids falls outside said desired range; and selectively recirculating to said separator the unused catalyst that exits from said separator.

2. The method as defined in claim 1 including the step of providing a receptacle for said separated solids component, and the step of conveying said separated solids component to said receptacle.

3. The method as defined in claim 1 including the step of providing a water reclamation system, and the step of conveying said separated liquid component to said water reclamation system.

4. The method as defined in claim 1 wherein said separator is a decanting centrifuge with a screw auger.

5. The method as defined in claim 1 wherein said catalyst has an electric charge.

6. A method as defined in claim 5 including the step of recharging said unused catalyst before it returns to the feed slurry.

7. The method as defined in claim 1 wherein the step of recirculating said unused catalyst includes adding said recirculating unused catalyst to said feed slurry.

8. A method as defined in claim 7 including the step of applying a charge to the feed slurry.

9. The method as defined in claim 1 including the step of separating said catalyst from said liquid component; said last named step including the step of selecting a catalyst that when unused by the feed slurry floats on the separated liquid component, and skimming the unused catalyst off of the separated liquid component.

* * * * *